US007395612B2

(12) United States Patent
Jeong et al.

(10) Patent No.: US 7,395,612 B2
(45) Date of Patent: Jul. 8, 2008

(54) DRUM FOR USE IN DRYER WITH TUMBLER SECTIONS

(75) Inventors: Seong Hai Jeong, Changwon-si (KR); Ju Han Yoon, Changwon-si (KR); Soo Won Park, Changwon-si (KR); In Hee Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 48 days.

(21) Appl. No.: 10/891,064

(22) Filed: Jul. 15, 2004

(65) Prior Publication Data

US 2005/0126034 A1 Jun. 16, 2005

(30) Foreign Application Priority Data

Dec. 11, 2003 (KR) ..... 10-2003-0090093

(51) Int. Cl.
*F26B 11/02* (2006.01)

(52) U.S. Cl. ..... 34/602; 34/603; 34/604; 34/606; 68/140; 68/143

(58) Field of Classification Search ..... 34/602–606; 68/140, 143

See application file for complete search history.

(56) References Cited

U.S. PATENT DOCUMENTS

| | | | | | |
|---|---|---|---|---|---|
| 3,402,576 | A * | 9/1968 | Krupsky | 68/4 |
| 3,584,393 | A * | 6/1971 | Menk | 34/562 |
| 4,430,809 | A * | 2/1984 | Jackson et al. | 34/601 |
| 4,702,018 | A * | 10/1987 | Hastings | 34/130 |
| 5,421,103 | A * | 6/1995 | Wunderlich | 34/599 |
| 5,495,681 | A * | 3/1996 | Paradis | 34/602 |
| 6,283,902 | B1 * | 9/2001 | Bakoledis | 492/30 |

* cited by examiner

*Primary Examiner*—Stephen Gravini
(74) *Attorney, Agent, or Firm*—Ked & Associates, LLP

(57) ABSTRACT

A drum for use in a dryer is provided. The drum includes a plurality of segments joined axially to form the drum's cylindrical shape. The drum has a simple structure enabling the use of standardized segments to facilitate dryer manufacture by reducing production costs, increasing productivity, and reducing failure rates. The drum, which has a cylindrical shape, is composed of a plurality of segments, preferably, three, each arranged axially with respect to the axis of the drum. The drum includes a coupling mechanism, provided on each side edge of each segment, for joining the segments to form the cylindrical shape of the drum.

33 Claims, 5 Drawing Sheets

DRUM FOR USE IN DRYER WITH TUMBLER SECTIONS

This application claims the benefit of Korean Application No. P2003-090093, filed on Dec. 11, 2003, which is hereby incorporated by reference.

BACKGROUND OF THE INVENTION

1. Field of the Invention

The present invention relates to dryers, and more particularly, to a drum for use in a dryer, which is composed of a plurality of segments joined axially to form the drum's cylindrical shape.

2. Discussion of the Related Art

Generally, a dryer uses hot air to dry laundry that has been washed. The dryer basically includes a drum for processing the laundry, a heating unit for supplying the drum with heated air, and an air discharging unit for expelling the hot air from the drum.

FIG. 1 illustrates a drum for use in a general dryer. The drum 10, provided with a drying chamber 5 to accommodate laundry, is installed within an outer case (not shown) of the dryer, to be slowly rotated by a belt (not shown) wound in a belt groove 2 formed in the drum's outer surface. At least one lifter 12, installed lengthwise on the inner surface of the drum 10, is provided to raise the laundry in the drying chamber 5 to a predetermined height as the drum rotates, at which point the laundry falls in a tumbling action, to thereby evenly expose the laundry to hot air and assist in drying.

To fabricate the above drum, a thin plate of metal such as stainless steel is rolled into a cylindrical shape, or drum, and is welded at the edges to create a seam. To reinforce the strength of the drum, a die is used to press the welded drum and thus expand predetermined portions of the drum's periphery. The lifters, which are typically made of plastic and are separately fabricated, are then coupled to the drum's inner surface.

Fabricating such a drum, however, requires very large machinery, e.g., a press, which necessitates an expensive facility and high capital equipment investment. A complicated process inherently lowers productivity and increases failure rates. Also, since the drum is made of steel, unpleasant levels of noise are generated by the tumbling laundry, which tends to have metallic accessories and hard buttons that collide with the inner surface of the rotating drum.

SUMMARY OF THE INVENTION

Accordingly, the present invention is directed to a dryer that substantially obviates one or more problems due to limitations and disadvantages of the related art.

An object of the present invention is to provide a drum for use in a dryer, in which the drum has a simple structure enabling the use of standardized segments to facilitate dryer manufacture.

An object of the present invention is to provide a drum for use in a dryer, which enables reduced production costs and facilitates mass production.

Another object of the present invention is to provide a drum for use in a dryer, which increases productivity while reducing failure rates.

A further object of the present invention is to provide a drum for use in a dryer, which reduces noise levels generated during drying.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a drum for use in a dryer for drying laundry, wherein the drum has a cylindrical shape and is comprised of a plurality of segments. Herein, the segments are each arranged axially with respect to an axis of the drum. Preferably, the drum includes three segments.

The drum further includes coupling means, provided on each side edge of each segment, for joining the plurality of segments to form the cylindrical shape of the drum. The coupling means includes a pair of overlapping extensions respectively formed at mating side edges of each segment.

Each segment has the same size and shape and thus can be standardized, with each segment having a predetermined curvature based on a diameter of the drum. Each segment comprises at least one lifter for lifting laundry, which is integrally formed with the segment thereby being positioned the same on each segment, preferably, along one side edge of each segment. Preferably, the segments are made of a reinforced plastic material and are formed by injection molding.

In another aspect of the present invention, there is provided a dryer having a cylindrical drum, wherein the drum includes a plurality of segments, each segment having an arc shape for forming the drum, and coupling means for joining the plurality of segments to form the drum.

Herein, the drum further includes a plurality of lifters corresponding to the plurality of segments, each lifter being integrally formed with a corresponding segment.

In a further aspect of the present invention, a dryer includes a rotatable drum, composed of a plurality of segments, for drying laundry, a heating unit for generating hot air and supplying the rotatable drum with the hot air to dry the laundry, and an air discharging unit for expelling the hot air from the rotatable drum.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
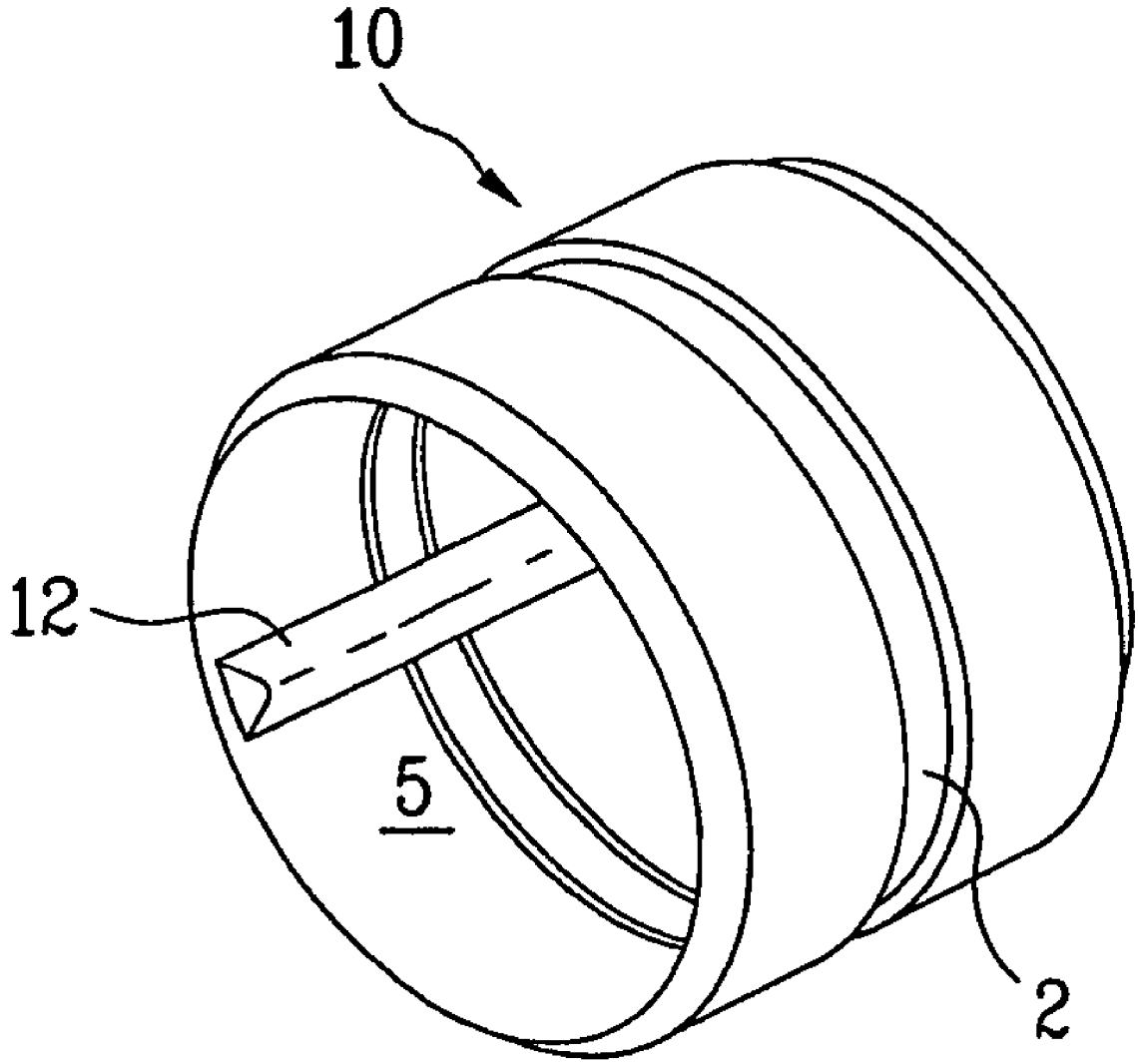
FIG. 1 Related Art
FIG. 1 is a perspective view of a drum of a general dryer.
Figure 2:
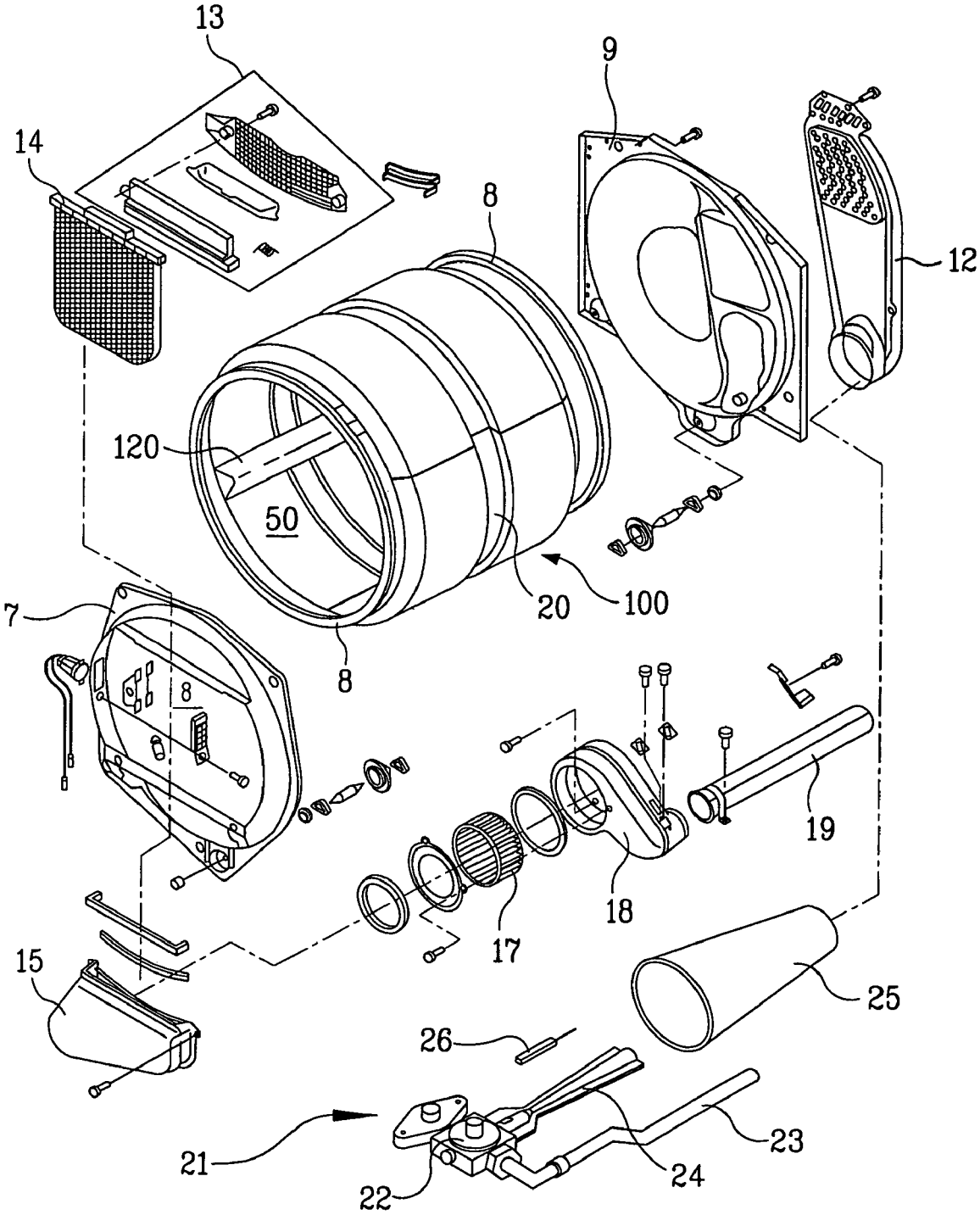
FIG. 2 is a perspective breakaway view of a dryer adopting a drum according to the present invention.

Referring to FIG. 2, illustrating a dryer adopting a segmented drum according to the present invention, a drum 100, provided with a drying chamber 50 to accommodate laundry, is installed within an outer case (not shown) of the dryer, to be slowly rotated by a belt (not shown) wound in a belt groove 20 formed in the drum's outer surface. A plurality of lifters 120, formed lengthwise on the inner surface of the drum 100, is provided to raise the laundry in the drying chamber 50 to a predetermined height as the drum rotates, at which point the laundry falls in a tumbling action, to thereby evenly expose the laundry to hot air and assist in drying.

A front head 7 and a rear head 9, respectively installed at each end of the drum 100, provide support for the ends of the rotating drum. Here, the drum 100 may have open ends, but the rearward end may be a closed end per product specification. Sealing members 8 for preventing leakage are respectively installed between the drum 100 and the front and rear heads 7 and 9.

An air discharging unit, for expelling heated air for drying the laundry, is installed at a lower end of the inlet port 8 of the front head 7 to discharge air from the drying chamber 50. The air discharging unit includes an outlet port assembly 13, a lint filter 14, a lint duct 15, a blower 17, and a discharging pipe 19. The lint filter 14 is installed at the outlet port assembly 13 and filter foreign material from the air exiting the drying chamber 50. The lint duct 15 is installed to communicate with the outlet port assembly 15. The lint filter 14 is disposed over the intake of the lint duct 15 and the outlet port assembly 13. The blower 17 is connected with the lint duct 15, thereby sucking internal air of the drying chamber 50 through the lint duct 15. The blower 17 is installed within a blower housing 18. The blower housing 18 has one end communicating with the lint duct 15 and the other end connecting with the discharge pipe 19. Accordingly, the blower 17 discharges air, which passes through the lint duct 15 from the drying chamber 50, through the discharge pipe 19.

A heating unit is installed at the rear head 9 to heat and supply air to the chamber 50 of the drum 100. For the heating unit, an air supplying duct 12 is installed at the rear head 9. The air supplying duct 12 functions as a passage through which the heated air is supplied to the drying chamber 50. A hot air duct 25 is connected with the air supplying duct 12. The hot air duct 25 induces hot air to be used inside the drying chamber 50. For this, a gas nozzle 22 comprised of a gas burner 21 is installed at an inlet port of the hot air duct 25. The gas nozzle 22 sprays the supplied gas. The gas nozzle 22 includes a valve for controlling the supply of the gas via a gas pipe 23. A mixing unit 24 is extending from the inlet port to the intake of the hot air duct 25 to aerate the gas sprayed from the gas nozzle 22 by mixing the gas with external air introduced through an inlet port. A spark plug 26 is installed at a front end of the mixing unit 24 to generate an ignition spark.

Figure 3:
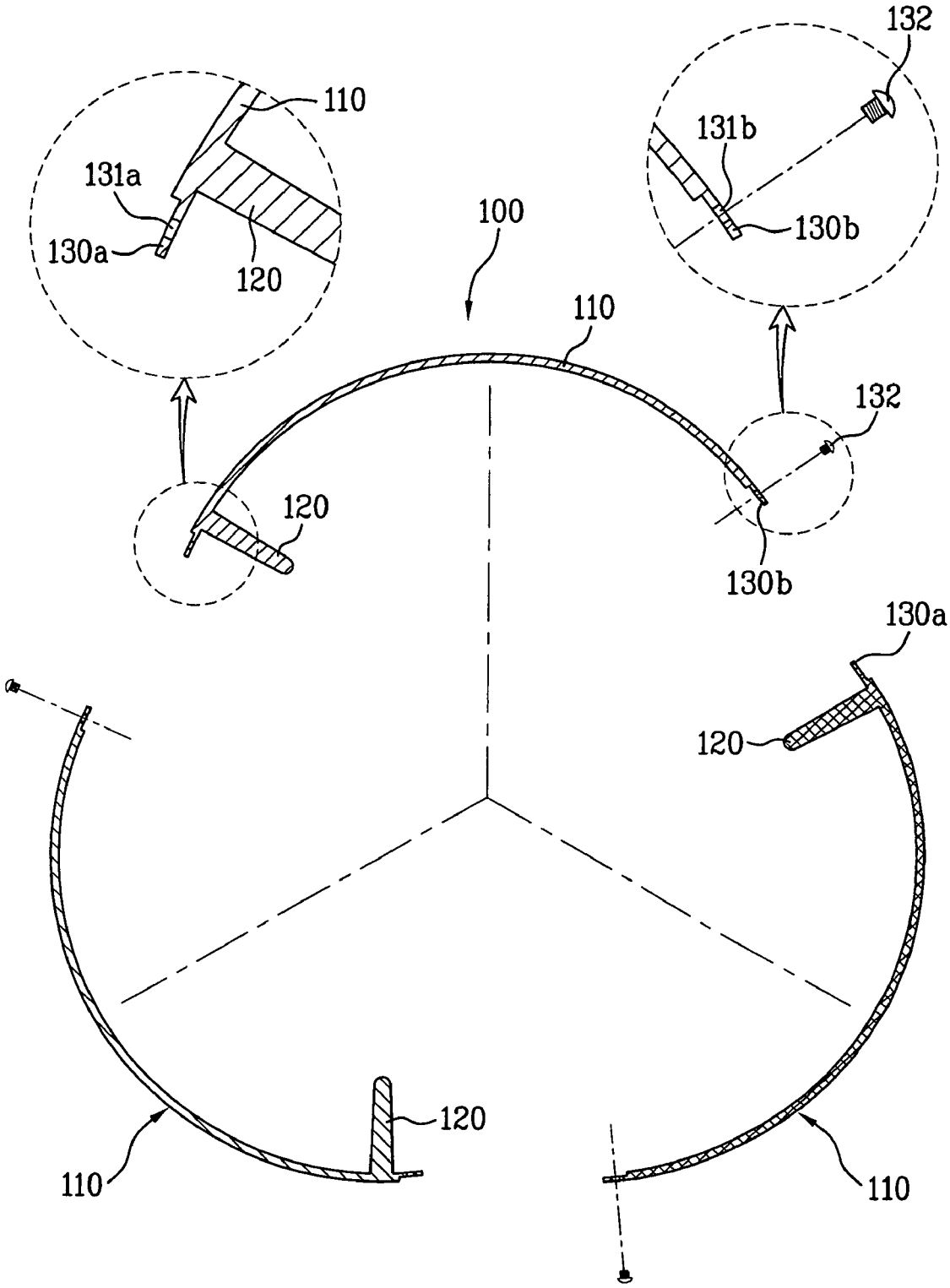
FIG. 3 is a sectional breakaway view of a drum according to one embodiment of the present invention.
Figure 4:
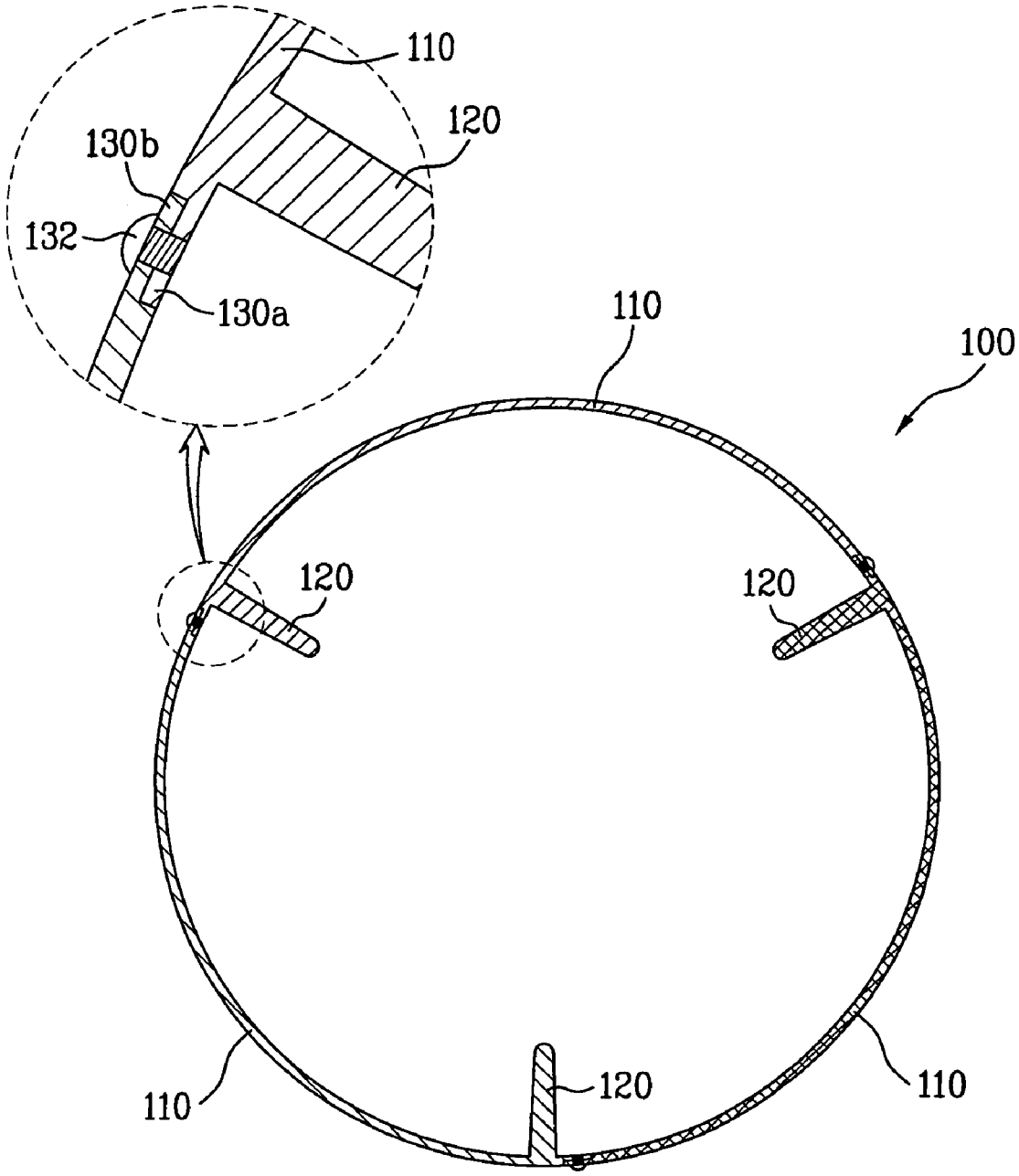
FIG. 4 is a sectional view of the drum of FIG. 2.

Referring to FIG. 3, illustrating a drum for use in a dryer according to one embodiment of the present invention, the drum 100 includes a plurality of segments 110, to be coupled to one another (or linked) as shown in FIG. 4. The segments 110 are arranged lengthwise (or axially) with respect to the drum 100 and are coupled using a plurality of coupling means, which are also arranged axially.

Each segment 110 is comprised of a plate member having a predetermined curvature (or arc) based on the diameter of the drum, such that, when assembled, the segments substantially form a circle, i.e., a cross-section of a cylinder, corresponding to the cylindrical shape of the drum 100. Though fabricated as separate components, the plate members are roughly equivalent to pieces that would result from axially splitting a single-bodied cylindrical drum into a number of equal-sized pieces. According to the present invention, the segments 110 all have the same size and shape, so that a specification of the segments can be standardized, which facilitates mass production of the segments through a simple and repeatable process.

Furthermore, due to the segmentation of the drum 100, the lifters 120 may be integrally formed with the segments 110, and each lifter 120 may be formed at the same position of a corresponding segment, preferably, to be disposed along one side of the segment. Thus, the number of lifters preferably corresponds to the number of segments 110. Such an integrated formation of the segments is in contrast to a conventional drum having a unified structure necessitating separately fabricated and subsequently installed lifters, which are coupled to the drum using a plurality of coupling members. In manufacturing a dryer adopting a drum according to the present invention, the present invention obviates the need for a separate coupling step for each lifter. Accordingly, the plurality of lifters 120 can be provided while maintaining the same, standardized size and shape of the segments 110.

Though the segments 110 can be fabricated by any one of various methods, a standardized specification of the segments enables their fabrication through casting, which requires relatively little production equipment, as known in the art, and is suitable for mass production. In other words, the segments 110 can be molded in a single mold for integrally forming the lifters 120. No large machine tools are required.

The drum 100 is preferably formed of a reinforced plastic material, which is lightweight and still exhibits high strength and is therefore more advantageous than steel. Furthermore, no excessive noise is generated when laundry collides with the inner of surface a plastic drum. In cases where the reinforced plastic material is applied, the segments are preferably manufactured using injection molding, which is more effective than plastic casting.

The number of segments 110 is preferably three. If the drum 100 is composed of just two segments 110, each segment has a relatively large curvature, which encumbers the molding or casting and reduces the precision of the resulting segment, while a drum having more than three segments unduly encumbers the assembly of the drum and slows production accordingly.

To assemble the drum 100, the segments 110 are coupled using a coupling means. The drum 100 is provided with a plurality of such coupling means along the axial length of the drum.

In the embodiment shown in FIGS. 3 and 4, the coupling means comprises a pair of overlapping extensions 130*a* and 130*b* provided at the mating side edges of the segments, which are respectively provided with coupling holes 131*a* and 131*b*, for receiving a coupling member 132, such as a screw or bolt. When the segments 110 are combined to form the cylindrical shape of the drum 100, the coupling holes 131*a* and 131*b* are aligned, and accordingly, one of the coupling holes is threaded, preferably, that (131*a*) of the inner extension 130*a*.

Figure 5:
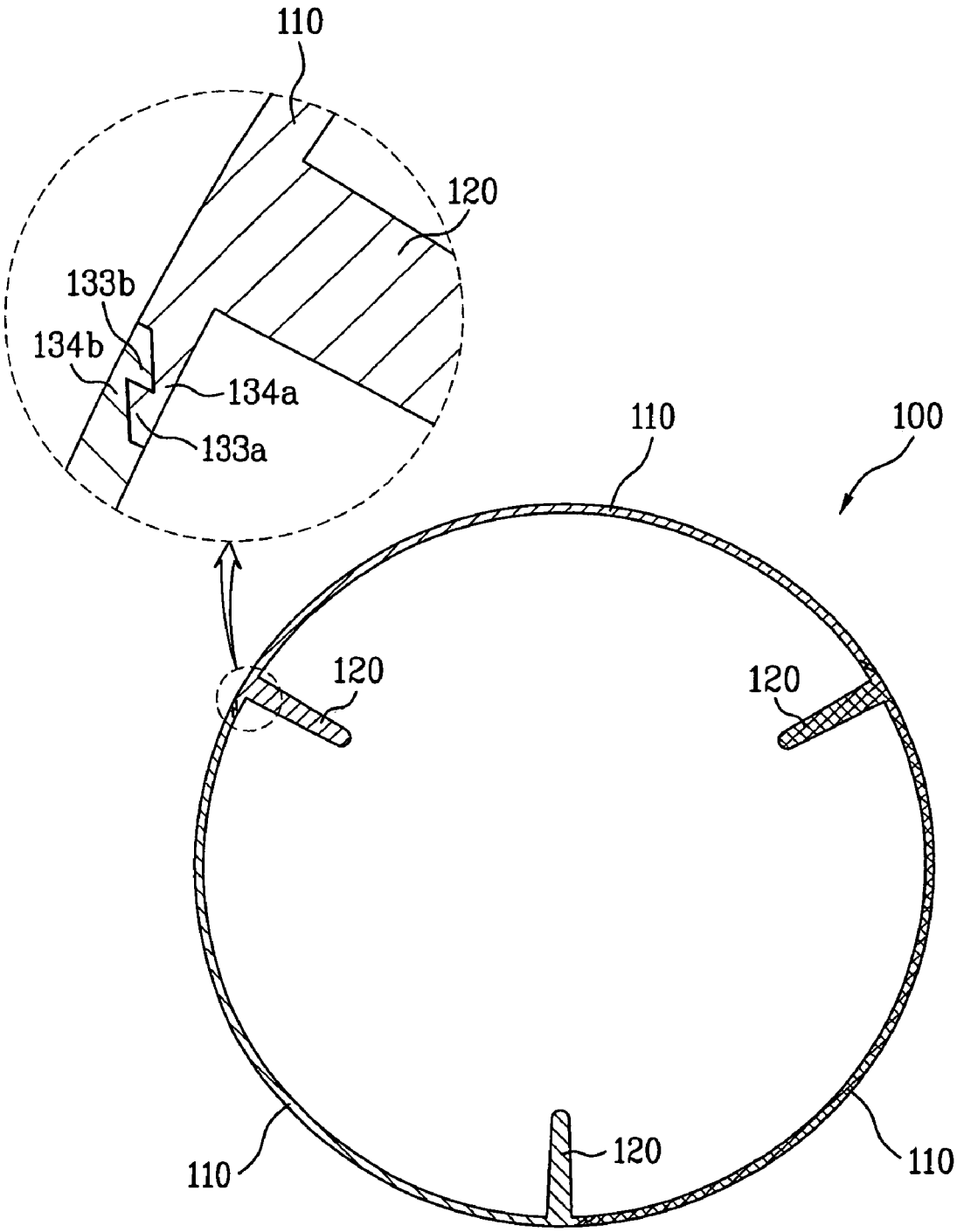
FIG. 5 is a sectional view of a drum according to another embodiment of the present invention.

In the embodiment shown in FIG. 5, the segments 110 are directly coupled, i.e., without a coupling member, by overlapping a pair of extensions 134*a* and 134*b*, which are respectively provided with a pair of opposing hooks 133*a* and 133*b*. Thus, the segments 110 are coupled at the mating side edges by engaging the hooks 133*a* and 133*b*, e.g., with a snap fit, or by fusing the mating surfaces using a heat source such as a laser.

As described above, a drum according to the present invention is composed of a plurality of segments, which are standardized to have the same size and shape, that is, the same specification, thus reducing the production costs of such a drum and facilitating its mass production. Owing to the production of standardized segments using casting techniques, no large machine tools are required, which reduces capital equipment costs and simplifies the overall manufacture process. Therefore, improved productivity and reduced defective rates can be anticipated, which further reduces production costs.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A drum for use in a dryer, wherein the drum has a cylindrical shape and is rotatable within the dryer, wherein the drum comprises a plurality of segments, wherein each of the plurality of segments extends longitudinally along an entire length of the drum, and wherein a side edge of each of the plurality of segments is configured to overlap a corresponding side edge of an adjacent segment so as to couple the adjacent segments and form a cylindrical body portion of the drum, and wherein each segment of the plurality of segments comprises at least one lifter for lifting laundry, the at least one lifter being integrally formed with its respective segment.

2. The drum as claimed in claim 1, wherein each of the plurality of segments is arranged axially with respect to an axis of the drum.

3. The drum as claimed in claim 1, wherein the plurality of segments comprises three segments.

4. The drum as claimed in claim 1, wherein the plurality of segments are joined by coupling means for joining side edges of adjacent segments of the plurality of segments to form the cylindrical body portion of the drum.

5. The drum as claimed in claim 4, wherein the coupling means is provided on each side edge of each of the plurality of segments.

6. The drum as claimed in claim 4, wherein the coupling means comprises a pair of overlapping mating side edges of adjacent segments of the plurality of segments.

7. The drum as claimed in claim 6, wherein the coupling means further comprises a coupling member.

8. The drum as claimed in claim 7, wherein each overlapping mating side edge comprises a coupling hole for receiving the coupling member, wherein the coupling holes are configured to align when adjacent segments are joined.

9. The drum as claimed in claim 8, wherein the coupling hole is threaded to receive the coupling member.

10. The drum as claimed in claim 6, wherein each overlapping mating side edge comprises an opposing hook for engaging the side edge of an adjacent segment.

11. The drum as claimed in claim 6, wherein the mating side edges of adjacent segments are fused together using a heat source.

12. The drum as claimed in claim 1, wherein each segment of the plurality of segments has a predetermined curvature based on a diameter of the drum.

13. The drum as claimed in claim 1, wherein each segment of the plurality of segments has substantially the same size and shape.

14. The drum as claimed in claim 1, wherein the lifters are formed at the same position on their respective segment.

15. The drum as claimed in claim 1, wherein the lifters are formed along one side edge of their respective segment.

16. The drum as claimed in claim 1, wherein each of the plurality of segments is made of a plastic material.

17. The drum as claimed in claim 16, wherein the plurality of segments are formed by injection molding.

18. A dryer, comprising:

a cylindrical drum which is rotatable within the dryer, the drum comprising:

a plurality of segments, each segment having an arc shape with side edge portions configured to overlap with adjacent segments so as to form a cylindrical body portion of the drum;

coupling means for joining the plurality of segments to form the drum; and a plurality of lifters corresponding to the plurality of segments, each lifter being integrally formed with a corresponding segment of the plurality of segments.

19. A dryer, comprising:

a rotatable drum, comprising a plurality of arcuate segments, wherein the plurality of arcuate segments are configured to overlap at respective longitudinal side edges thereof so as to be coupled to form a cylindrical body portion of the drum, wherein each of the plurality of segments comprises at least one lifter formed as a single body with its respective segment;

a heating unit for generating hot air and supplying the hot air to the rotatable drum to dry the laundry; and an air discharging unit for expelling the hot air from the rotatable drum.

20. The drum as claimed in claim 18, wherein each of the plurality of segments extends longitudinally along an entire length of the drum.

21. The drum as claimed in claim 1, wherein each of the plurality of segments forms an arcuate portion of the drum.

22. A dryer comprising the drum of claim 1.

23. The dryer as claimed in claim 19, wherein each of the plurality of arcuate segments extends longitudinally along an entire length of the rotatable drum.

24. The dryer as claimed in claim 18, wherein the drum further comprises coupling means for joining side edges of adjacent segments of the plurality of segments to form the cylindrical body portion of the drum, wherein the coupling means is provided on each side edge of each of the plurality of segments.

25. The dryer as claimed in claim 24, wherein the coupling means comprises a pair of overlapping extensions respectively formed at mating side edges of adjacent segments of the plurality of segments and a coupling member, and wherein each overlapping extension comprises a coupling hole for receiving the coupling member, wherein the coupling holes are configured to align when adjacent segments are joined.

26. The dryer as claimed in claim 24, wherein the coupling means comprises a pair of overlapping extensions respectively formed at mating side edges of adjacent segments of the plurality of segments, and wherein each overlapping extension comprises an opposing hook for engaging the side edge of an adjacent segment.

27. The dryer as claimed in claim 19, wherein the drum further comprises coupling means for joining side edges of adjacent segments of the plurality of segments to form the cylindrical body portion of the drum, wherein the coupling means is provided on each side edge of each of the plurality of segments.

28. The dryer as claimed in claim 27, wherein the coupling means comprises a pair of overlapping extensions respectively formed at mating side edges of adjacent segments of the plurality of segments and a coupling member, and wherein each overlapping extension comprises a coupling hole for receiving the coupling member, wherein the coupling holes are configured to align when adjacent segments are joined.

29. The dryer as claimed in claim 27, wherein the coupling means comprises a pair of overlapping extensions respectively formed at mating side edges of adjacent segments of the plurality of segments, and wherein each overlapping extension comprises an opposing hook for engaging the side edge of an adjacent segment.

30. The drum as claimed in claim 1, wherein the corresponding side edges of adjacent segments of the plurality of segments are configured to overlap along an entire longitudinal length of the adjacent segments.

31. The drum as claimed in claim 1, wherein each of the plurality of segments is not rotatable relative to an adjacent segment when the plurality of segments are joined.

32. The dryer as claimed in claim 18, wherein each side edge portion of each segment is configured to overlap a corresponding side edge portion of an adjacent segment along an entire longitudinal length of the adjacent segments.

33. The dryer as claimed in claim 19, wherein the respective longitudinal side edges of the plurality of arcuate segments are configured to overlap along an entire longitudinal length of adjacent arcuate segments.

* * * * *